US006711842B1

(12) United States Patent
Chapman

(10) Patent No.: US 6,711,842 B1
(45) **Date of Patent: *Mar. 30, 2004**

(54) FIRING MECHANISM

(76) Inventor: Daniel L. Chapman, P.O. Box 710316, Santee, CA (US) 92072-0316

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,026

(22) Filed: Oct. 31, 1997

(51) Int. Cl.[7] ..... F41A 19/00
(52) U.S. Cl. ..... 42/69.01
(58) Field of Search ..... 42/69.02, 69.01, 42/65, 1.08, 1.15; 89/147, 150

(56) References Cited

U.S. PATENT DOCUMENTS

| | | | | | |
|---|---|---|---|---|---|
| 200,322 | A | | 2/1878 | Mauser | 42/47 |
| 356,378 | A | | 1/1887 | Schlegelmilch | 42/43 |
| 363,577 | A | | 5/1887 | Berg et al. | 42/41 |
| 414,797 | A | | 1/1889 | Comstock | 42/69.01 |
| 404,779 | A | | 6/1889 | Dicer et al. | 42/41 |
| 422,731 | A | | 3/1890 | Comstock | 42/43 |
| 444,574 | A | | 1/1891 | Blachon et al. | 42/40 |
| 543,366 | A | | 7/1895 | Young et al. | 42/43 |
| 704,898 | A | | 7/1902 | Meigs et al. | 89/27.11 |
| 975,071 | A | | 11/1910 | Ricketts | 42/42.01 |
| 1,371,527 | A | | 3/1921 | Thompson | 42/2 |
| 1,392,024 | A | | 9/1921 | Payne | 42/41 |
| 1,430,218 | A | | 9/1922 | Dessard | 42/43 |
| 1,476,125 | A | | 12/1923 | Wesson et al. | 42/12 |
| 1,558,158 | A | | 10/1925 | Frommer | 42/47 |
| 1,674,907 | A | | 6/1928 | Lindsay | 42/40 |
| 1,788,443 | A | * | 1/1931 | Sedgley | 42/69 |
| 2,031,383 | A | | 2/1936 | Mendoza | 42/69.02 |
| 2,296,998 | A | * | 9/1942 | Koehler | 89/150 |
| 2,603,021 | A | | 7/1952 | Paulve | 42/43 |
| 2,805,604 | A | * | 9/1957 | Humphrey | 42/69 |
| 2,851,929 | A | | 9/1958 | Milroy, Jr. | 42/7 |
| 3,153,874 | A | | 10/1964 | Merrill | 42/8 |
| 3,167,876 | A | | 2/1965 | Milroy, Jr. | 42/7 |
| 3,583,088 | A | * | 6/1971 | Buck et al. | 42/70 |
| 3,665,630 | A | * | 5/1972 | Taylor | 42/12 |
| 3,678,800 | A | * | 7/1972 | Seidel | 89/147 |
| 3,708,902 | A | * | 1/1973 | Foster et al. | 42/69 |
| 4,424,638 | A | * | 1/1984 | Hillberg | 42/69 |
| 4,722,148 | A | * | 2/1988 | Walker | 42/40 |
| 5,050,480 | A | | 9/1991 | Knight, Jr. | 42/7 |
| 5,081,780 | A | | 1/1992 | Lishness et al. | 42/69.01 |
| 5,109,622 | A | * | 5/1992 | Echeberria | 42/69.02 |
| 5,135,151 | A | * | 8/1992 | Logan | 42/69.01 |
| 5,179,233 | A | * | 1/1993 | Du Plessis | 42/69.02 |
| 5,223,649 | A | | 6/1993 | Claridge | 42/70.01 |
| 5,412,894 | A | * | 5/1995 | Moon | 42/69.02 |
| 5,502,914 | A | * | 4/1996 | Moon | 42/69.02 |
| 5,640,794 | A | * | 6/1997 | Gardner et al. | 42/69.02 |
| 5,664,357 | A | * | 9/1997 | Kilfitt et al. | 42/69.01 |
| D400,633 | S | * | 11/1998 | Chapman | D22/100 |

FOREIGN PATENT DOCUMENTS

| | | |
|---|---|---|
| FR | 535530 | 4/1922 |
| FR | 836859 | 1/1939 |

OTHER PUBLICATIONS

Ezell, Edward C. *Handguns of the World*, Stalkpole Books, Harrisburg, PA, 1981, pp. 666–667.

* cited by examiner

*Primary Examiner*—Charles T. Jordan
*Assistant Examiner*—Denise J Buckley

(57) ABSTRACT

A firing mechanism which allows a reduction in the overall length of a handgun by making use of space longitudinally forward of the breechface, beneath the barrel. The firing element is longitudinally slidable and has a projection which cooperates with a firing pin. A rebound spring acts on the projection and allows compatibility with a self cocking trigger. The required longitudinal space is further reduced by a longitudinal aperture through the firing element which allows the firing element to pass over the front of the driving spring guide.

20 Claims, 14 Drawing Sheets

FIRING MECHANISM

BACKGROUND - Field of Invention

This invention relates to firearms, specifically to the firing mechanism of a handgun designed for minimum overall length.

BACKGROUND - Description of Prior Art

The minimization of overall handgun length has long been recognized as a desirable design objective.

Shortly after the invention of the metallic cartridge, standing breech pistols designed for minimum size had already standardized around several features, including a firing mechanism incorporating a pivoted external hammer combined with a single action pivoted trigger, such as shown in U.S. Pat. No. 51,440 (Elliot) and U.S. Pat. No. 105,388 (Thuer).

The pivoted external hammer firing mechanism, as incorporated in these designs, suffers from several significant disadvantages. Foremost among these is a needless increase in overall firearm length. That portion of the gun set behind the breech end of the barrels is longer than necessary because it must both accommodate the long radius arc of hammer motion and still provide a handgrip extending beyond the rearwardmost point described by the arc, so as not to create interference between the hand and hammer while firing. The result is a waste of linear space which increases overall length. The corollary of this disadvantage is that the barrel is necessarily shorter for any given overall gun length than would otherwise be possible.

The pivoted external hammer creates another disadvantage in that it requires the gun to be grasped for firing below the lowest point of the hammer spur's arc. This results in a longer moment arm between hand and barrel axis and consequently creates an undesirable increase in the torque experienced by the shooter during recoil.

This design also suffers from the disadvantage of being slow to bring into a ready condition, as the pivoted external hammer must be manually cocked before firing. Since firearms of this class are frequently carried on the person, the pivoted external hammer suffers from a further inherent disadvantage. The protruding hammer may become snagged on a holster or clothing and thereby interfere with the drawing of the gun.

Despite these significant disadvantages of the prior art, standing breech pistols designed for minimum size have advanced little since the nineteenth century. Direct derivatives of nineteenth century designs are still currently in production.

Pistols with a firing mechanism consisting of a pivoted internal hammer combined with a self cocking pivoted trigger, such as shown in U.S. Pat. No. 3,193,960 (Stevens Jr.) mitigate some of the secondary disadvantages of traditional design. The pivoted internal hammer pistol however, still suffers from the primary disadvantage of needlessly large size. The long radius arc of hammer motion which needlessly increases the length of the gun is merely concealed, not eliminated. The corollary disadvantage of necessarily shorter barrel length for a given length gun is also not overcome.

Prior art attempts at maximizing barrel length for a given length handgun have focused on relatively large target arms, such as shown in U.S. Pat. No. 1,476,125 (Wesson et al). This design uses a longitudinally slidable external hammer for the purpose of reducing the length of that portion of the gun behind the breech end of the barrel.

Despite addressing the issue of barrel length, the longitudinally slidable external hammer design ignores the issue of overall gun length. In addition, this design also suffers from many of the same disadvantages as the previously discussed pivoted external hammer guns.

The gun must be grasped for firing below the path of the hammer's travel, so as not to create interference between the hand and hammer while firing. As before, this results in the disadvantage of a longer moment arm between hand and barrel axis and consequently creates an undesirable increase in the torque experienced during recoil.

This design likewise suffers from the disadvantage of being slow to bring into a ready condition, as the longitudinally slidable external hammer must be manually cocked before firing.

Although perhaps of little consequence on a target arm, the longitudinally slidable external hammer suffers from a further disadvantage if applied to a gun carried on the person. As with pivoted hammer designs, the protruding hammer may become snagged on a holster or clothing and thereby interfere with the drawing of the gun.

OBJECTS AND ADVANTAGES

Accordingly, among the objects and advantages of the present invention are:

(a) to provide a firing mechanism which minimizes overall gun length;

(b) to provide a firing mechanism which maximizes barrel length for a given overall gun length.

Further objects and advantages are to provide a firing mechanism which does not require manual cocking, has no external projections to snag on a holster or clothing, and eliminates constraints to minimizing moment arm length between the shooter's hand and barrel axis. Still further objects and advantages will be made evident from a consideration of the following description and drawings.

DRAWING FIGURES

REFERENCE NUMERALS IN THE DRAWINGS

10 Single shot pistol

12 Right grip plate

Figure 1:
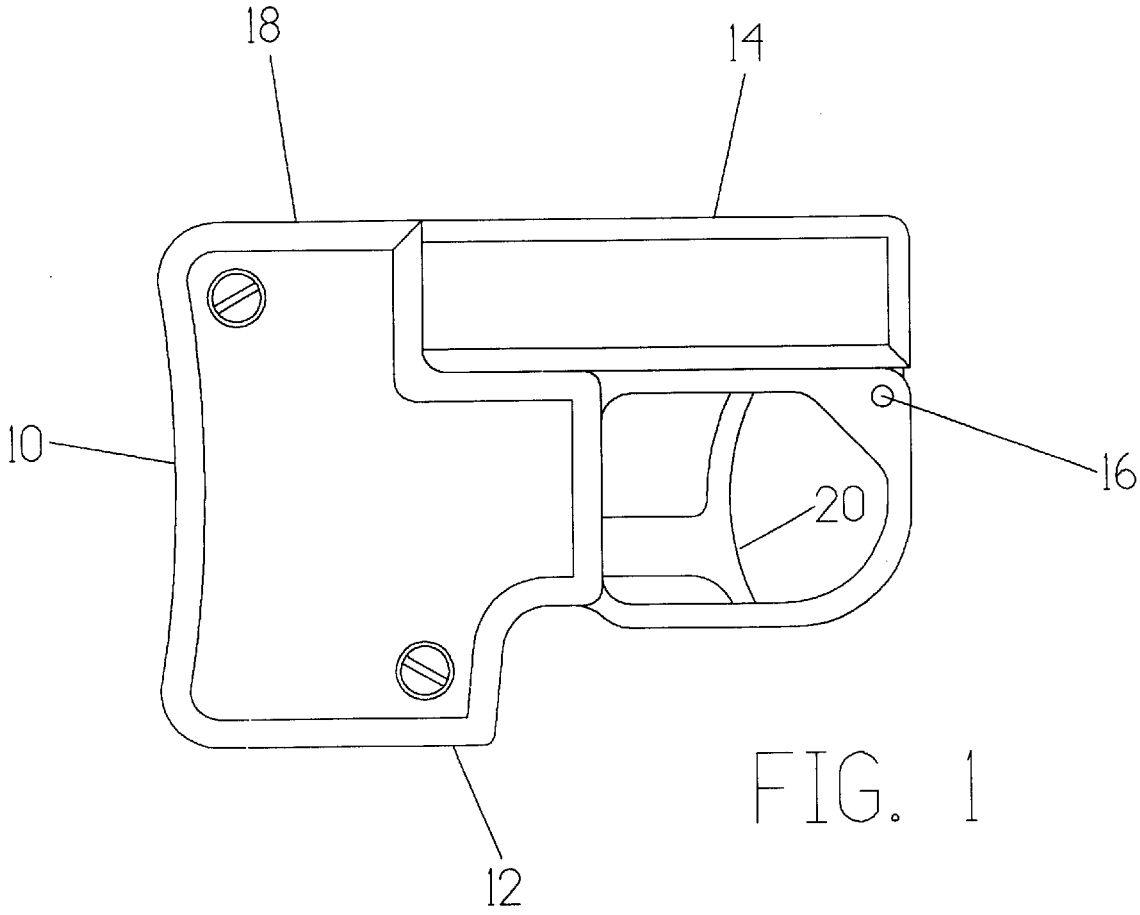
FIG. 1 is a right side view of a single shot pistol incorporating the invention.

14 Barrel
16 Hinge pin
18 Frame
20 Trigger
22 Triggerbar
24 Trigger return spring
26 Sear
28 Firing element
30 Sear catch
32 Driving Spring
33 Guide
36 Recess
38 Surface
40 Backstrap
46 Mandrel
48 Stop pin
100 Body of firing element
102 Projection of firing element
104 Firing pin
106 Well
108 Counterbore of body
110 Head of guide
112 Cross pin
114 Washer
116 Counterbore of projection
118 Rebound spring
120 Rebound spring guide
122 Rear radius
124 Head of rebound spring guide
126 Hole in body
128 Hole in projection
130 Countersink
132 Fillet
134 Separate firing pin
136 Parallel springs

DESCRIPTION—FIGS. 1 TO 14

FIG. 1 shows a standing breech single shot pistol 10 which incorporates the invention. Pistol 10 has a barrel 14, a frame 18, and a trigger 20. FIG. 1 also shows a right grip plate 12. Barrel 14 is pivotally mounted to frame 18 via a hinge pin 16.

Figure 2:
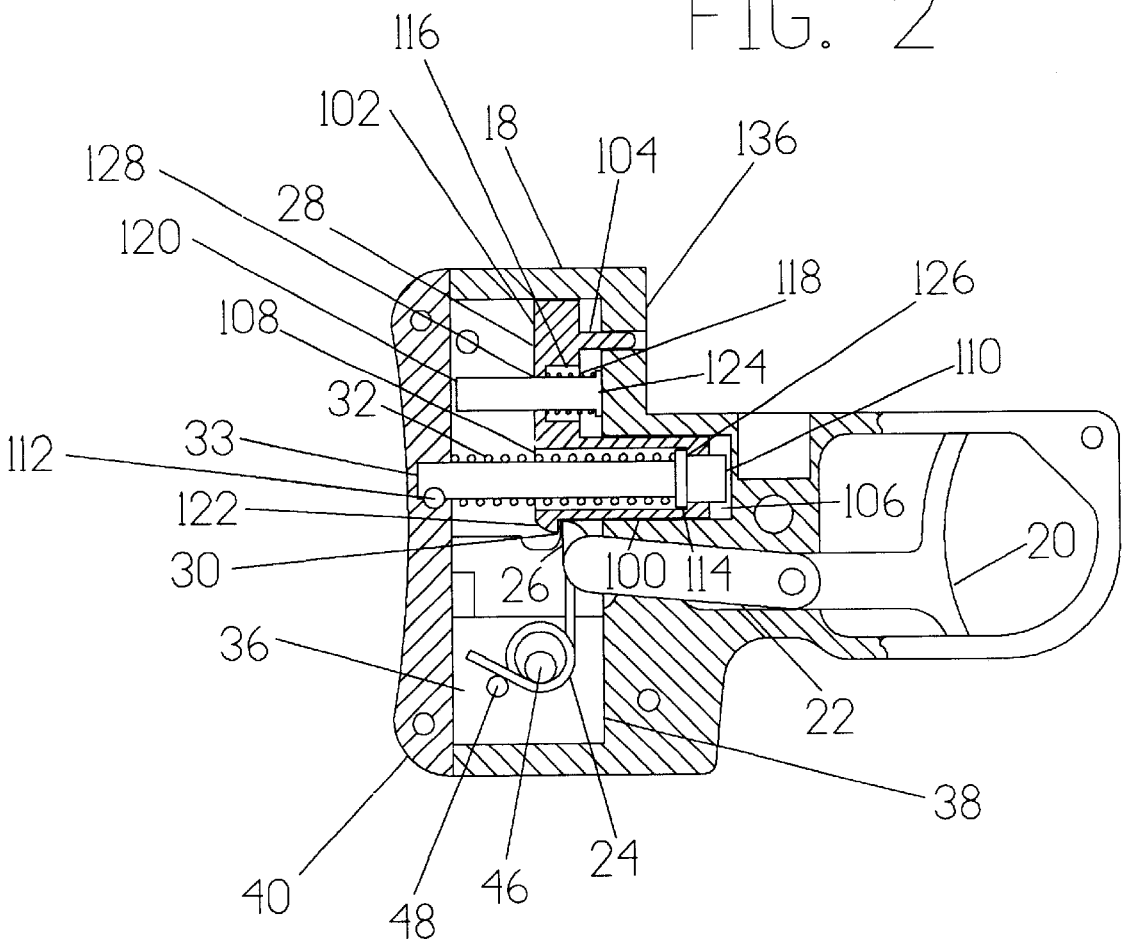
FIG. 2 is a partial sectional right side view of the frame.

FIG. 2 shows a self cocking trigger mechanism comprising trigger 20, a triggerbar 22, and a trigger return spring 24. A comparable trigger mechanism is disclosed in U.S. Patent application titled "Passive Safety Mechanism" filed 1997 October 31 which is hereby incorporated by reference in its entirety herein. Triggerbar 22 is pivotably connected to trigger 20. Trigger 20 is longitudinally slidable and is maintained in battery position by trigger return spring 24. Trigger return spring 24 is a left hand wound 90 degree torsion spring and is located within a recess 36 in frame 18. Trigger return spring 24 is mounted on a cross pin mandrel 46 and is constrained from rotation by a stop pin 48. Trigger return spring 24 bears upon triggerbar 22 and serves to place a forward bias on both trigger 20 and triggerbar 22. Trigger return spring 24 also has a vertical component of force which urges the free end of triggerbar 22 upward into the battery position. Triggerbar 22 has an integral sear 26 which engages a firing element 28 via a sear catch 30. Sear catch 30 has a rear radius 122 which facilitates clearance of sear 26 during the return of triggerbar 22 to battery after firing. Firing element 28 has a cylindrical body 100, a vertical projection 102, and a firing pin 104 fixed to projection 102. Firing element 28 is longitudinally slidable within recess 36 and extends into a well 106. A driving spring 32 of the helical compression type is mounted on a cantilever guide 33 and extends from the rear into an axial counterbore 108 within body 100. The advantage of this construction is that since body 100 and driving spring 32 extend longitudinally forward of a breechface 136, overall gun length is minimized and barrel length is maximized. A through hole 126 allows the free end of guide 33 to longitudinally extend out the front of body 100. The free end of guide 33 terminates in a larger diameter head 110. The fixed end of guide 33 is secured to a detachable backstrap 40 by a cross pin 112. Driving spring 32 is preloaded by a washer 114 which is slidably mounted on guide 33 and retained by head 110. Projection 102 has a through hole 128 and a counterbore 116 oriented in the opposite direction. Counterbore 116 accepts a helical compression rebound spring 118 which is supported by a cylindrical rebound spring guide 120 that extends through hole 128. The preload of rebound spring 118 is much less than that of driving spring 32; thus, full rebounding of firing element 28 is achieved when washer 114 abuts against hole 126. Rebound spring guide 2 has a larger diameter head 124 which retains rebound spring 118 and abuts against a surface 38 within frame 18. Rebound spring guide 120 is not fixedly attached and is positioned solely by alignment within hole 128. This simplifies assembly and manufacture.

Figure 9:
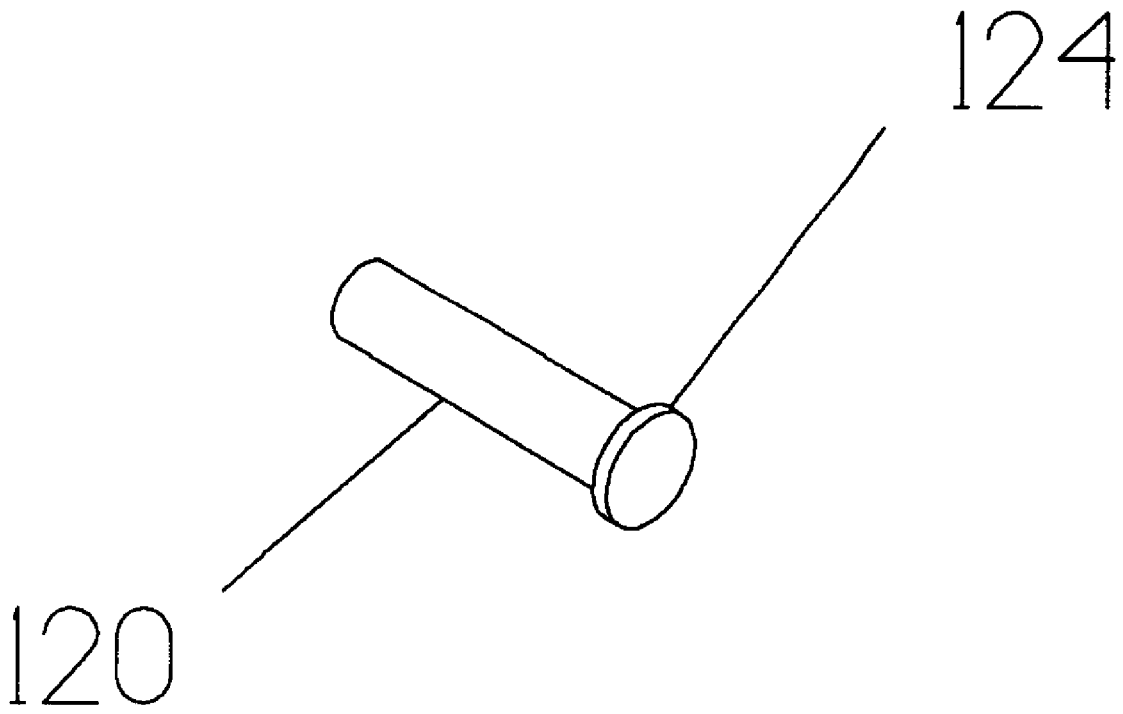
FIG. 9 is an isometric view of the rebound spring guide.
Figure 10:
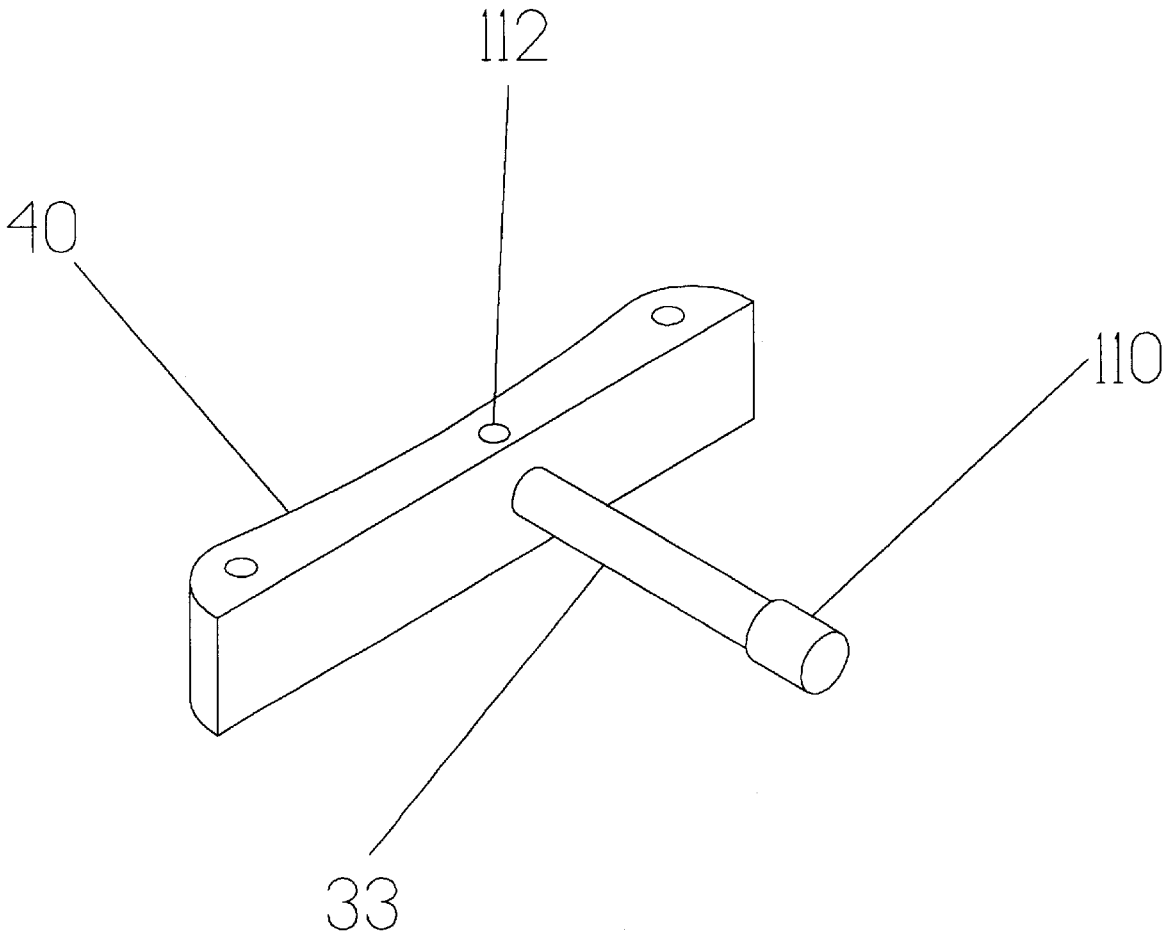
FIG. 10 is an isometric view of the detachable backstrap and driving spring guide.
Figure 14:
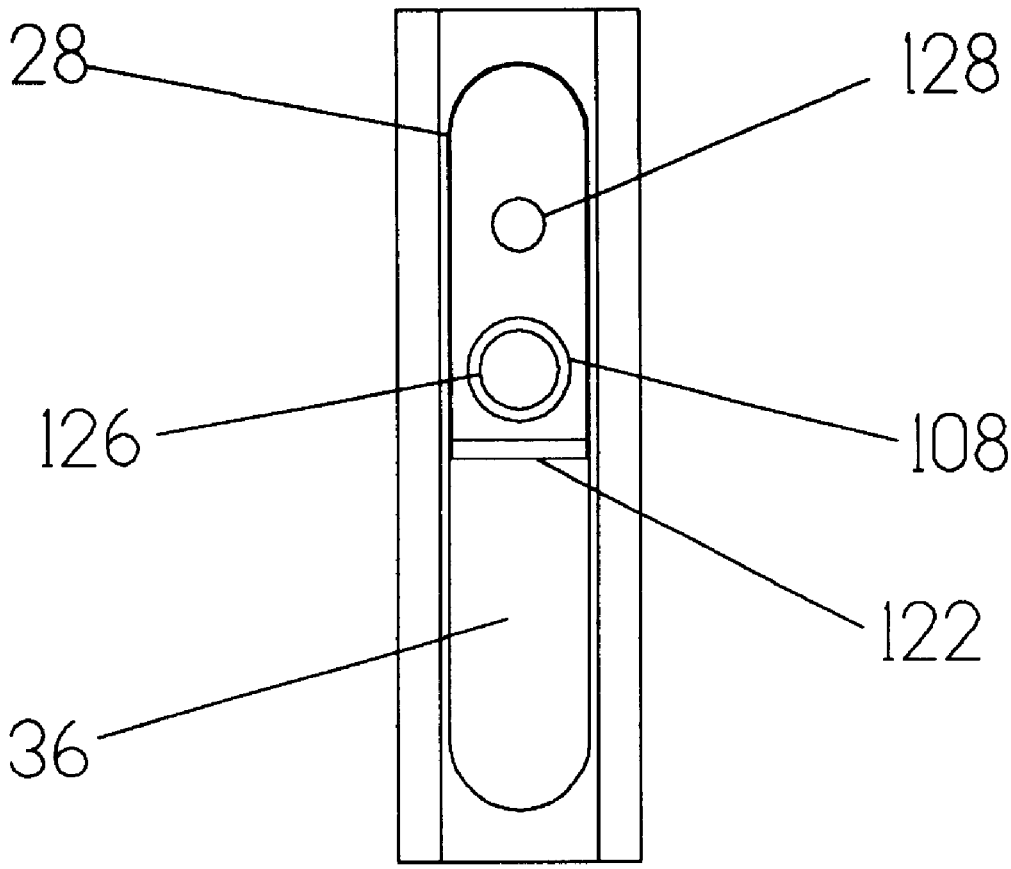
FIG. 14 is a rear view of the frame and firing element with the backstrap removed.

Rebound spring guide 120 can be seen more clearly in FIG. 9. FIGS. 5 through 8 depict firing element 28. Sear catch 30 of firing element 28 has substantially the same transverse width as body 100 and projection 102. FIG. 14 shows that firing element 28 also has substantially the same transverse width as recess 36. Guide 33 is shown mounted to backstrap 40 in FIG. 10. Washer 114 and driving spring 32 have been omitted for clarity.

Figure 3:
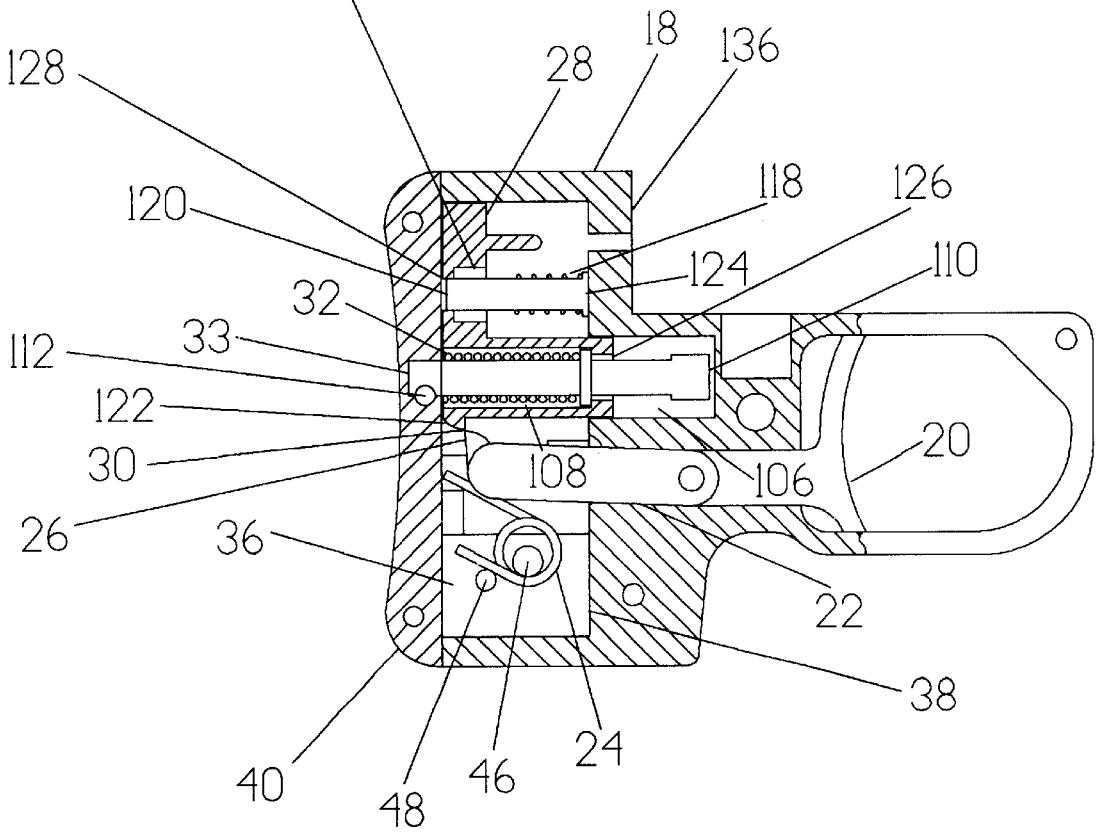
FIG. 3 is a partial sectional right side view of the frame showing rearward travel of the firing element.

In FIG. 3 trigger 20 has been translated rearward into the firing position. Trigger bar 22 and firing element 28 have translated with trigger 20. Triggerbar 22 has also been cammed downward to disengage sears from sear catch 30. Firing element 28 is about to be propelled fully forward by compressed driving spring 32. Note that rebound spring 118 has no preload and that rebound spring guide 120 has enough length to stay aligned within hole 128 when firing element 28 is at the rearward limit of travel.

Figure 4:
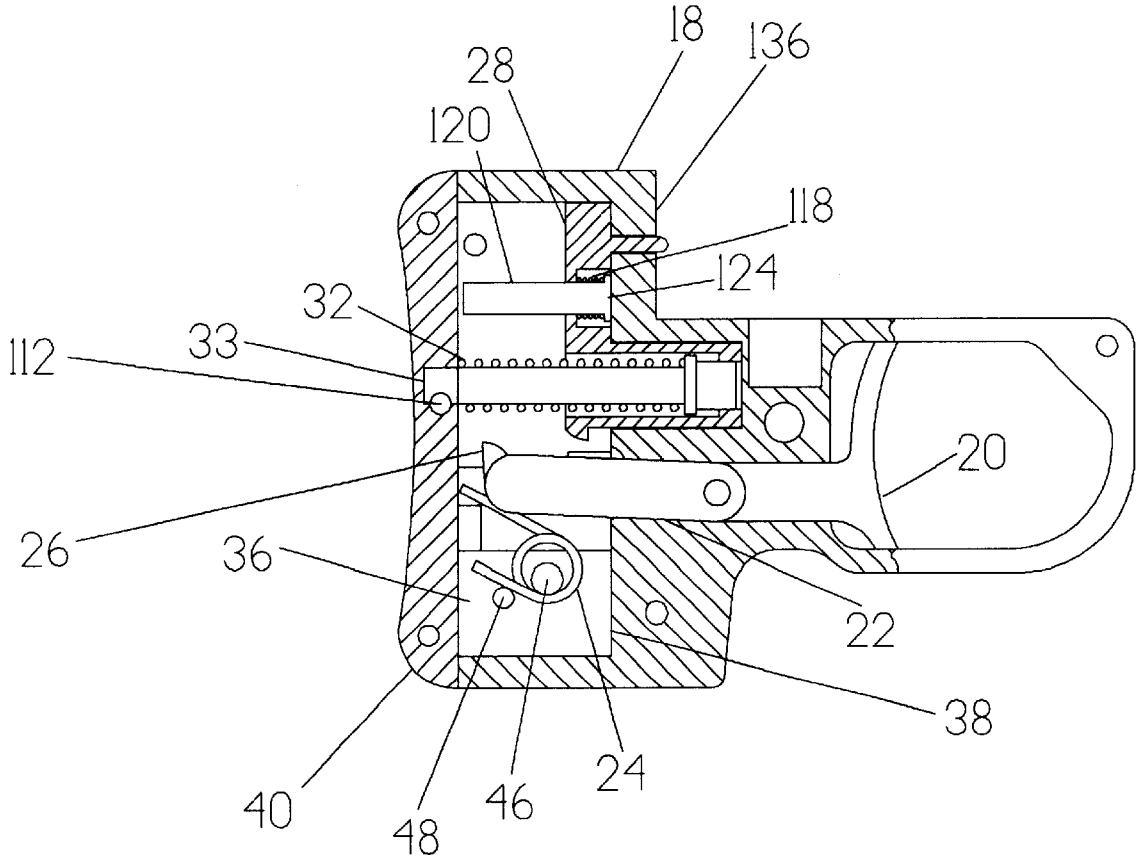
FIG. 4 is a partial sectional right side view of the frame showing forward travel of the firing element.
Figure 5:
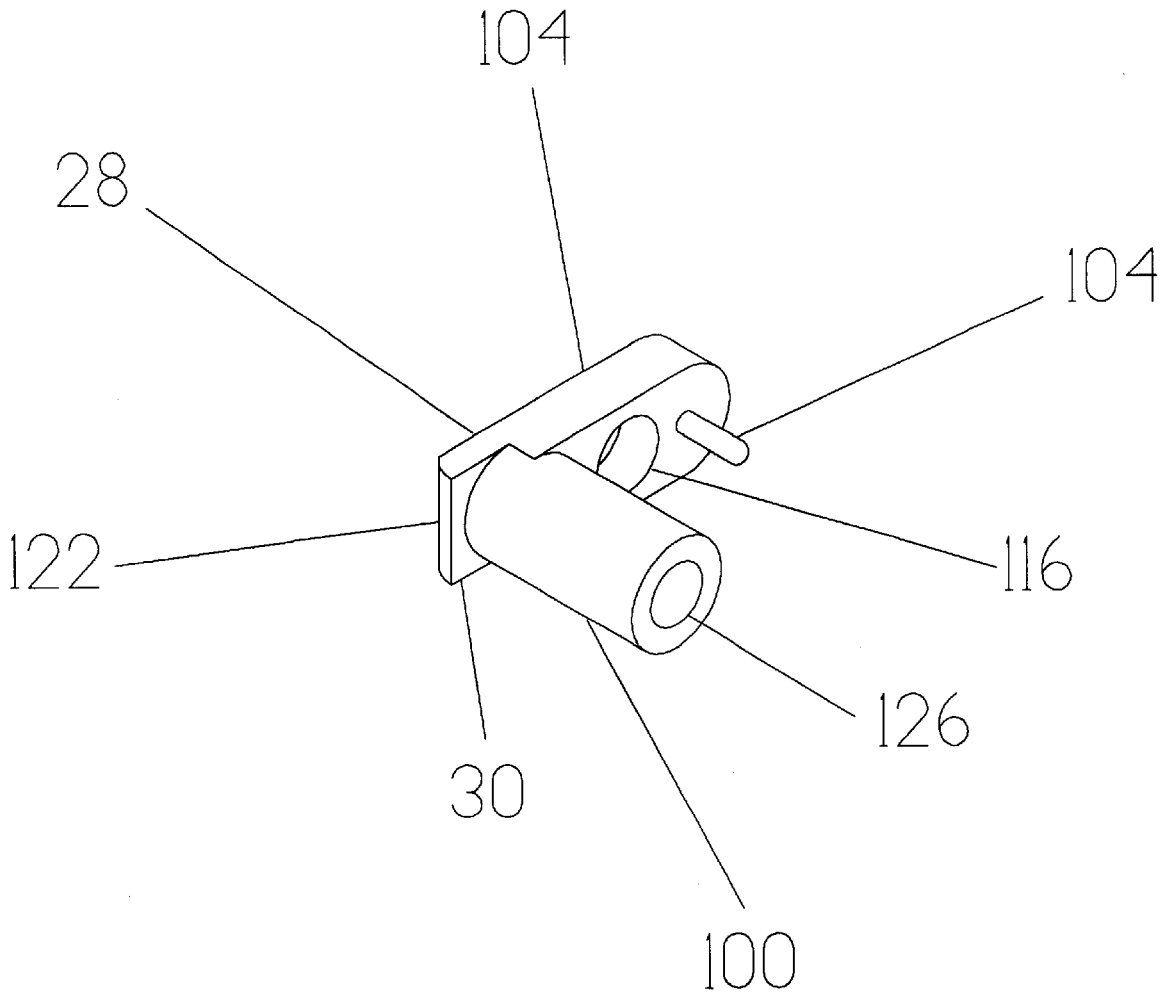
FIG. 5 is an isometric view of the firing element.
Figure 6:
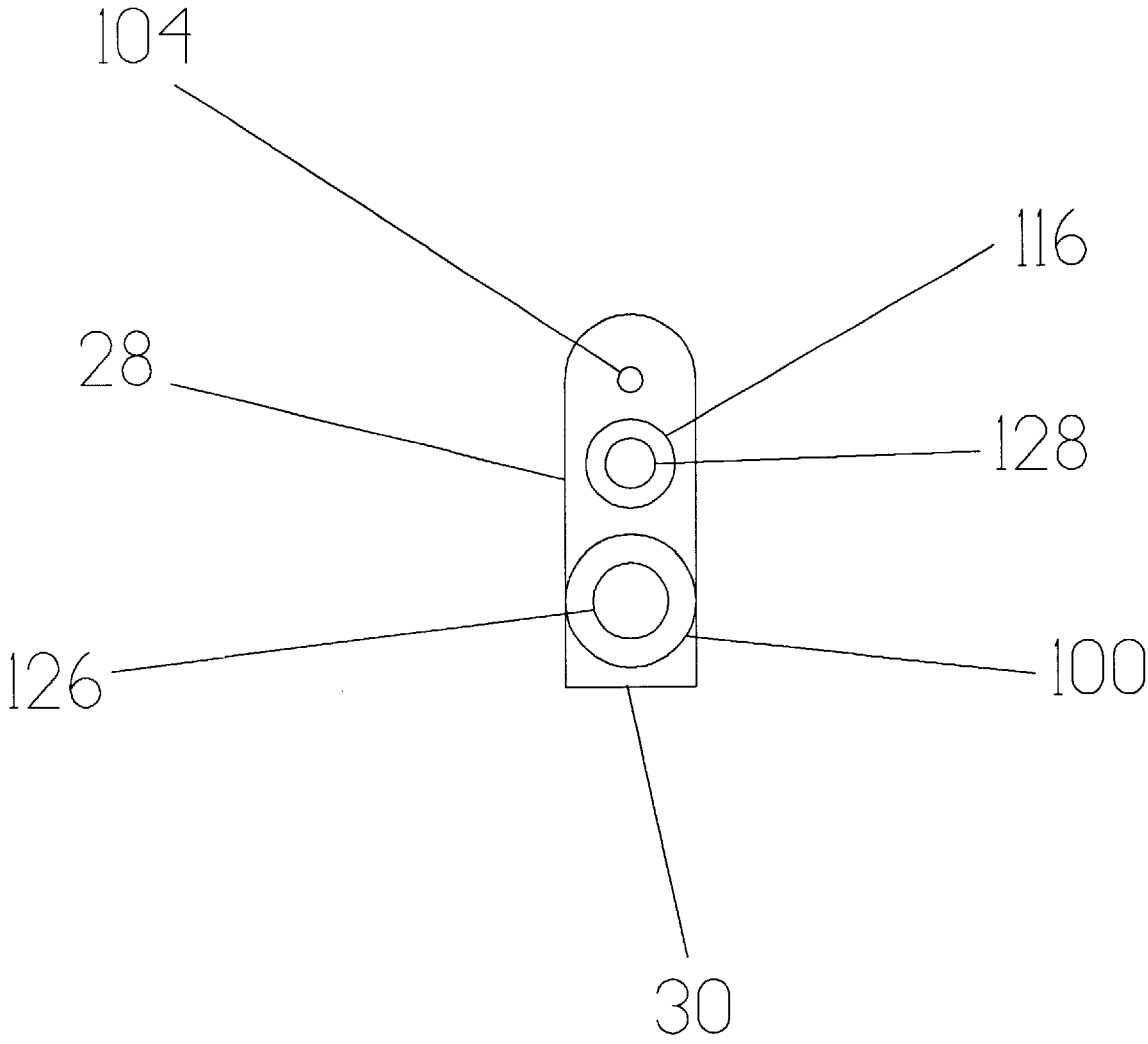
FIG. 6 is a front view of the firing element.
Figure 7:
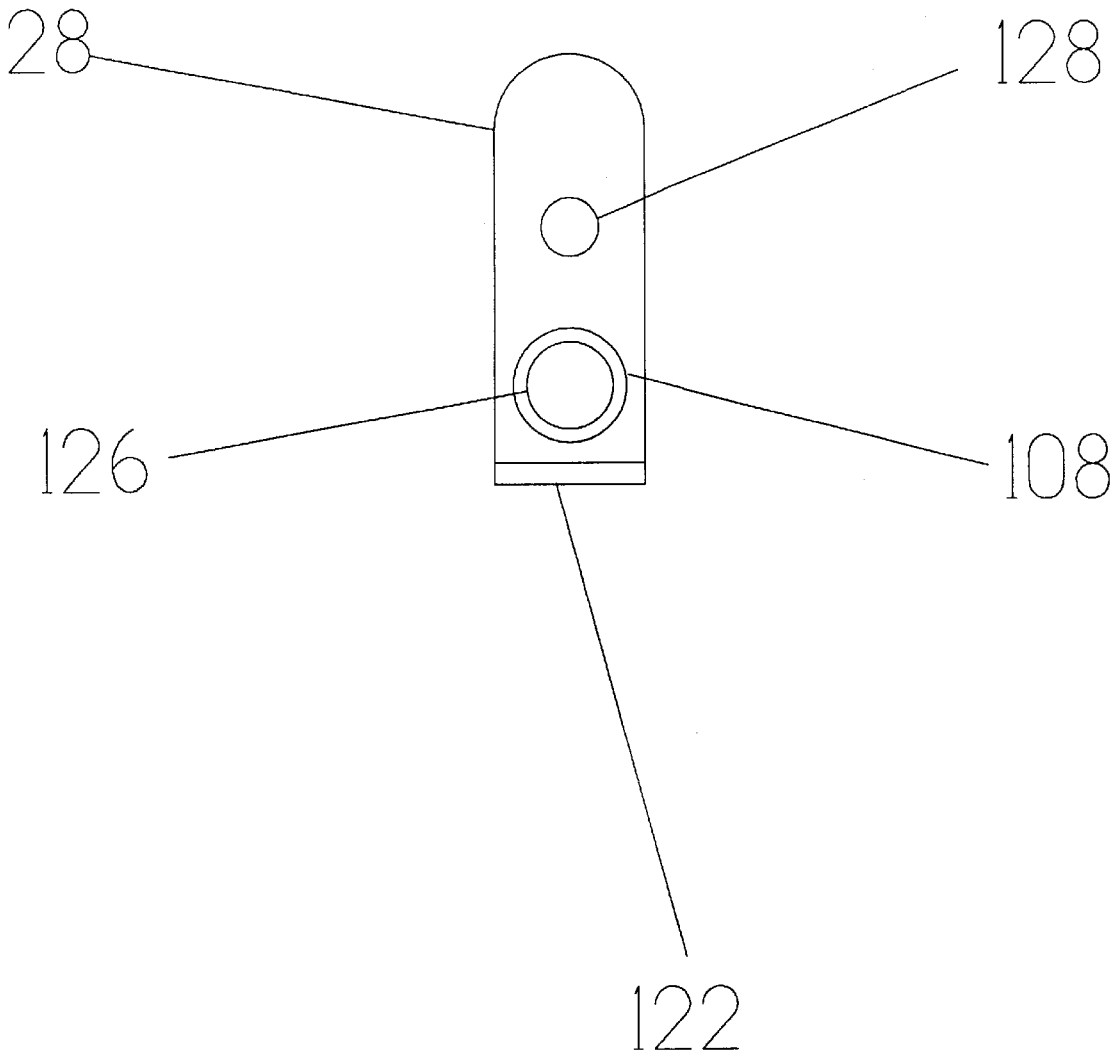
FIG. 7 is a rear view of the firing element.
Figure 8:
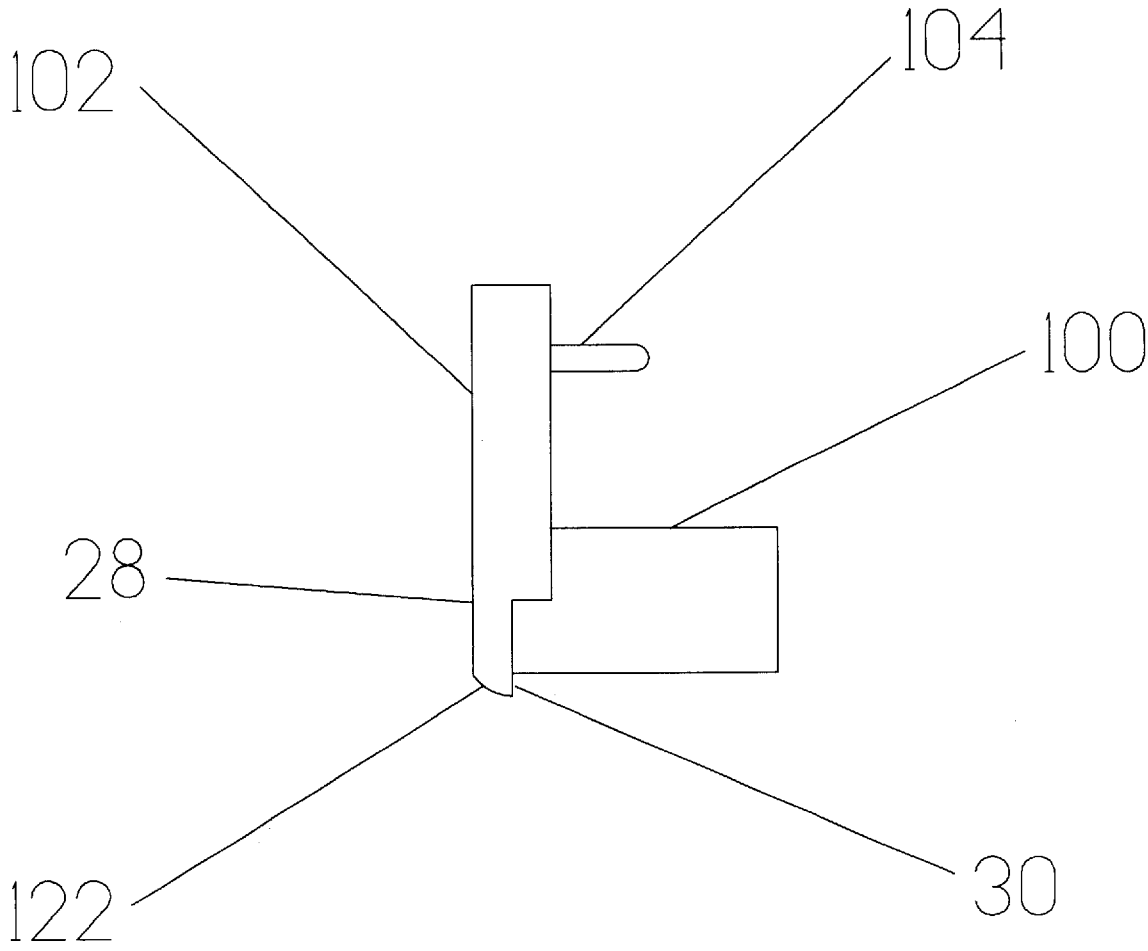
FIG. 8 is a right side view of the firing element.

In FIG. 4 firing element 28 is shown after having moved fully forward for firing. Driving spring 32 has returned to the original preloaded deflection. Rebound spring 118 has received additional compression and rebound of firing element 28 is imminent. Releasing trigger 20 after rebound will allow trigger 20 and triggerbar 22 to automatically reset to the battery position.

Figure 11:
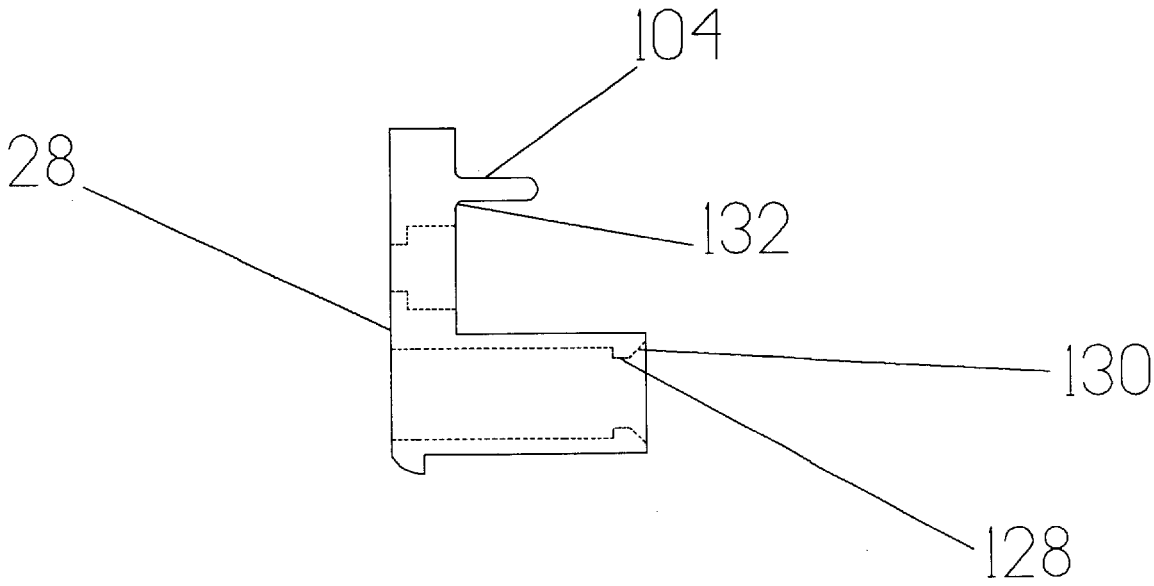
FIG. 11 is a right side view of an additional embodiment of the firing element.

FIG. 11 shows a variation in the design of firing element 28. Hole 128 has received a countersink 130. Countersink 130 facilitates the clearance of head 110 through hole 128. In addition, firing pin 104 has received a fillet 132 which reduces the probability of breakage.

Figure 12:
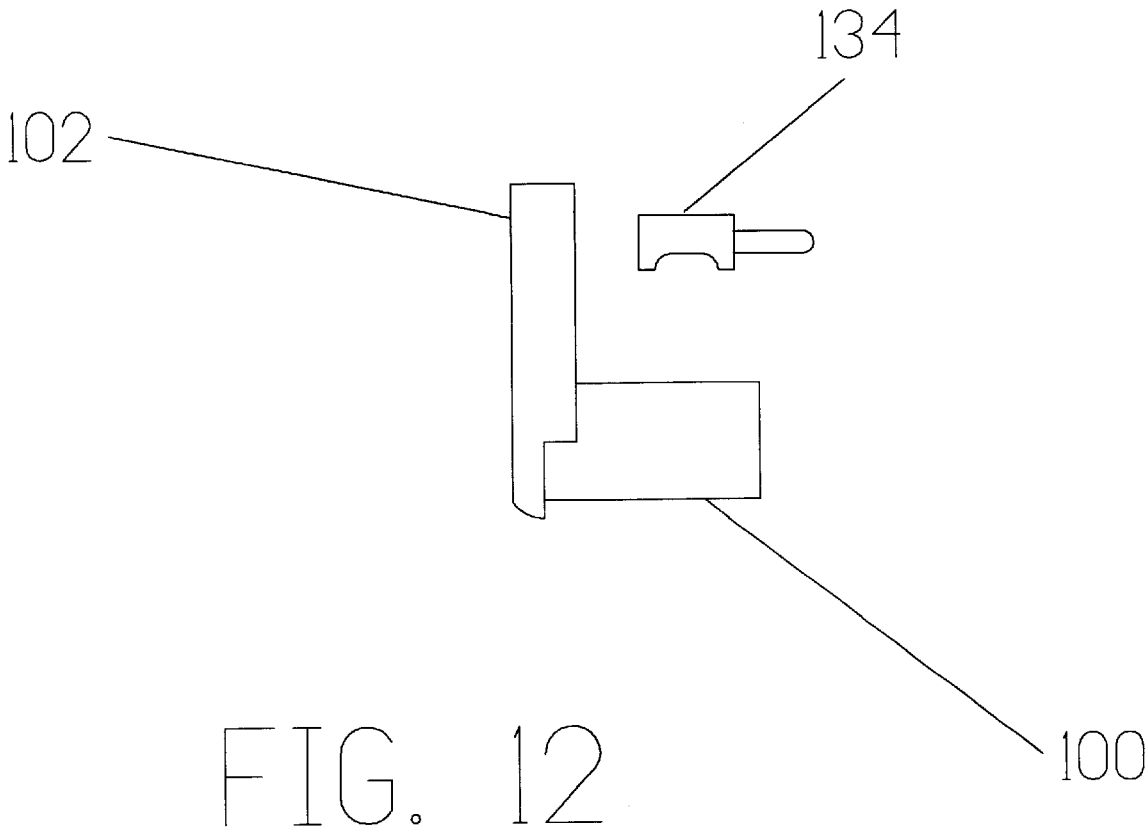
FIG. 12 is a right side view of an additional embodiment of the firing element using a separate firing pin.

FIG. 12 shows an additional variation. Instead of firing pin 104 fixed on projection 102, projection 102 acts upon a separate firing pin 134.

Figure 13:
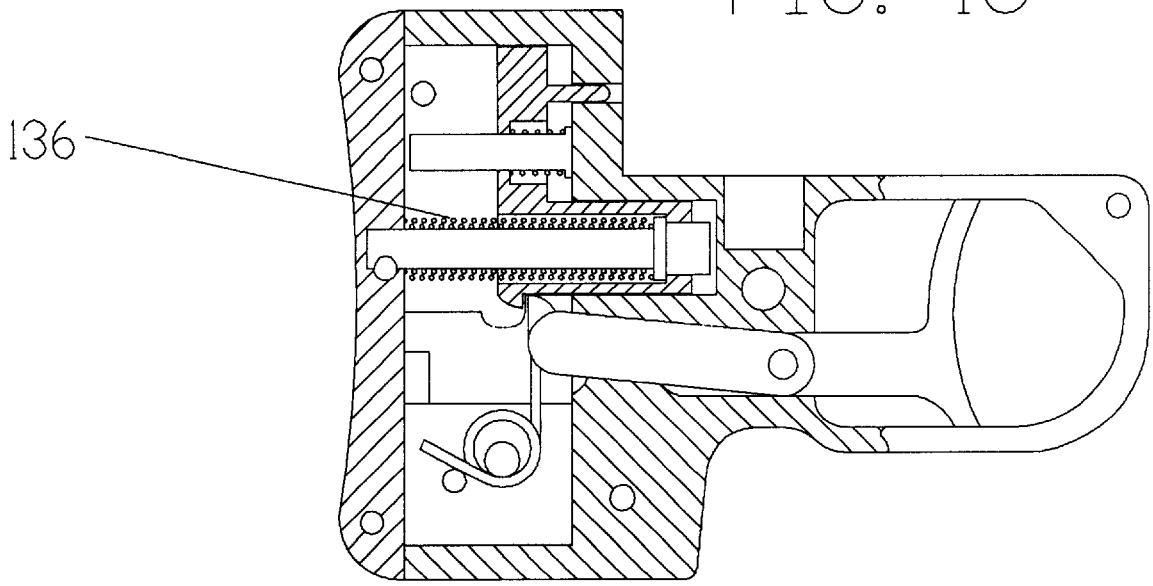
FIG. 13 is a partial sectional right side view showing an additional embodiment of the driving spring.

FIG. 13 shows still another variation. Driving spring 32 has been replaced by two parallel springs 136. Parallel springs 136 are concentric and have opposite helix directions to prevent entanglement. Parallel springs 136 offer the advantage of reduced solid height and further reduce the constraints to minimizing overall firearm length.

Conclusion, Ramifications, and Scope

The reader will see that the firing mechanism of this invention minimizes overall firearm length, maximizes barrel length for a given overall gun length, does not require manual cocking, has no external projections to snag on a holster or clothing, and eliminates constraints to minimizing the moment arm length between the shooter's hand and barrel axis.

Although the description above contains many specificities, these should not be construed as limiting the scope of the invention, but rather as an exemplification of one preferred embodiment thereof. Many other variations are possible. For example, the rebound spring guide could be fixedly attached to the backstrap or frame; the rebound spring guide could be made a captive component of the firing element; the head could be removed from the rebound spring guide, etc.

Accordingly, the scope of the invention should be determined not by the embodiment(s) illustrated, but, by the appended claims and their legal equivalents.

I claim:

1. In a firearm having a frame; a firing mechanism comprising:

a. a firing element having a radial projection which abuts on a firing pin;

b. said radial projection being located substantially toward the rear of said firing element;

c. a firing element driving spring which extends into said firing element from the rear;

d. a guide rod which extends into said firing element driving spring, said guide rod having greater length than said firing element;

e. a longitudinal through hole in said firing element which said guide rod may pass through;

characterized in that said firing element is longitudinally slidable relative to said frame and relative to said guide rod.

2. The firing mechanism of claim 1 wherein said guide rod is connected to a detachable backstrap which comprises part of a pistol grip.

3. The firing mechanism of claim 1 wherein a rebound spring is located above said firing element driving spring.

4. The firing mechanism of claim 1 wherein means for rebounding said firing element acts directly upon said radial projection.

5. The firing mechanism of claim 1 wherein said firing pin is attached to said radial projection.

6. The firing mechanism of claim 1 wherein said radial projection has a longitudinal through hole.

7. The firing mechanism of claim 1 wherein said radial projection accepts a rebound spring guide.

8. The firing mechanism of claim 1 wherein said radial projection is located at the rear of said firing element.

9. In a standing breech firearm having a trigger; a firing mechanism comprising:

a. a slidable firing element having a sear catch and a plurality of longitudinal through holes;

b. said firing element having a radial projection which abuts on a firing pin;

c. said radial projection providing said firing element with a substantially L shaped appearance;

d. a firing element driving spring capable of storing potential energy for propelling said firing element;

characterized in that rearward trigger motion is capable of increasing the load of said firing element driving spring.

10. The firing mechanism of claim 9 wherein said firing pin is attached to said radial projection.

11. In a firearm; a firing mechanism comprising:

a. a slidable firing element having a sear catch and a radial projection;

b. said radial projection being located substantially toward the rear of said firing element;

c. a firing element driving spring capable of storing potential energy for propelling said firing element toward a position which results in firing;

d. means for rebounding said firing element away from said position which results in firing;

e. the rebound means incorporating a rebound spring located above said firing element driving spring;

characterized in that said rebound means acts directly upon said radial projection.

12. The firing mechanism of claim 11 wherein said radial projection abuts on a firing pin.

13. The firing mechanism of claim 11 wherein a firing pin is attached to said projection.

14. The firing mechanism of claim 11 wherein said radial projection has a longitudinal through hole.

15. The firing mechanism of claim 11 wherein said radial projection accepts a rebound spring guide.

16. The firing mechanism of claim 11 wherein said radial projection is located at the rear of said firing element.

17. In a firearm; a firing mechanism comprising:

a. a slidable firing element having a longitudinal through hole;

b. said firing clement having a radial projection which abuts on a firing pin;

c. said radial projection being located substantially toward the rear of said firing element;

d. a firing element driving spring capable of storing potential energy for propelling said firing element toward a fully forward position;

e. a rebound spring to rebound said firing element away from said fully forward position;

f. said rebound spring being located above said firing element driving spring;

characterized in that said rebound spring acts upon said radial projection.

18. The firing mechanism of claim 17 wherein said firing pin is attached to said radial projection.

19. The firing mechanism of claim 17 wherein said radial projection has a longitudinal through hole.

20. The firing mechanism of claim 17 wherein said radial projection accepts a rebound spring guide.

* * * * *